US011910989B2

(12) United States Patent
Knight et al.

(10) Patent No.: US 11,910,989 B2
(45) Date of Patent: Feb. 27, 2024

(54) INTEGRATED CYCLONIC SEPARATOR IN A WET-DRY VACUUM

(71) Applicant: TECHTRONIC CORDLESS GP, Anderson, SC (US)

(72) Inventors: Tyler H. Knight, Greenville, SC (US); Stephen A. Hughett, Anderson, SC (US)

(73) Assignee: Techtronic Cordless GP, Anderson, SC (US)

( * ) Notice: Subject to any disclaimer, the term of this patent is extended or adjusted under 35 U.S.C. 154(b) by 81 days.

(21) Appl. No.: 17/678,806

(22) Filed: Feb. 23, 2022

(65) Prior Publication Data

US 2022/0265104 A1 Aug. 25, 2022

Related U.S. Application Data

(60) Provisional application No. 63/153,793, filed on Feb. 25, 2021.

(51) Int. Cl.
*A47L 9/16* (2006.01)
*A47L 7/00* (2006.01)
(Continued)

(52) U.S. Cl.
CPC ..... *A47L 9/1666* (2013.01); *A47L 7/0004* (2013.01); *A47L 9/122* (2013.01); *A47L 9/1691* (2013.01); *A47L 9/2884* (2013.01)

(58) Field of Classification Search
CPC ..... A47L 5/365; A47L 7/0004; A47L 7/0019; A47L 7/0028; A47L 9/16; A47L 9/1666; A47L 9/122; A47L 9/1691; A47L 9/2884
See application file for complete search history.

(56) References Cited

U.S. PATENT DOCUMENTS 3,552,100 A 1/1971 Ekenberg
3,820,310 A 6/1974 Fromknecht et al.
(Continued)

FOREIGN PATENT DOCUMENTS

AU 2017100402 A4 7/2017
CA 2260428 A1 7/2000
(Continued)

OTHER PUBLICATIONS

Extended European Search Report for Application No. 22158598.7 dated Jun. 19, 2023 (10 pages).

*Primary Examiner* — Don M Anderson
*Assistant Examiner* — Christopher Soto
(74) *Attorney, Agent, or Firm* — Michael Best & Friedrich LLP

(57) ABSTRACT

A wet-dry vacuum cleaner including a collecting bin and a power head removably coupled to the collecting bin. The power head includes a housing configured to support the power head on the collecting bin, an exhaust outlet, and a cyclonic separator positioned within the housing. The cyclonic separator includes a dirty air inlet, a chamber, and a clean air outlet. The power head further includes a suction motor assembly operable to create a working airflow path from the dirty air inlet to the exhaust outlet, and a filter disposed within a filter housing hanging downwardly from the suction motor assembly. The filter is positioned within the working airflow path adjacent the clean air outlet of the cyclonic separator.

15 Claims, 9 Drawing Sheets

(51) Int. Cl.
*A47L 9/12* (2006.01)
*A47L 9/28* (2006.01)

(56) References Cited

U.S. PATENT DOCUMENTS

| | | | | |
|---|---|---|---|---|
| 3,870,486 | A | 3/1975 | Eriksson et al. | |
| 3,877,902 | A * | 4/1975 | Eriksson | A47L 5/365 55/467 |
| 3,896,520 | A | 7/1975 | Williams | |
| 4,547,206 | A * | 10/1985 | Sovis | A47L 9/181 96/342 |
| 5,815,881 | A | 10/1998 | Sjogreen | |
| 6,251,296 | B1 | 6/2001 | Conrad et al. | |
| 6,684,093 | B2 | 1/2004 | Kuth | |
| 6,746,500 | B1 | 6/2004 | Park et al. | |
| 7,048,783 | B2 | 5/2006 | Ponjican et al. | |
| 7,293,324 | B2 | 11/2007 | Chui et al. | |
| 7,559,965 | B2 | 7/2009 | Oh et al. | |
| 7,615,088 | B2 | 11/2009 | Benedictus et al. | |
| 8,016,902 | B2 | 9/2011 | Makarov | |
| 8,117,713 | B2 | 2/2012 | Kasper et al. | |
| 8,146,201 | B2 | 4/2012 | Conrad | |
| 8,914,941 | B2 | 12/2014 | Kim et al. | |
| 9,155,437 | B2 | 10/2015 | Williams et al. | |
| 9,675,220 | B2 | 6/2017 | Kah, Jr. | |
| 10,653,281 | B2 | 5/2020 | Gierer et al. | |
| 10,729,296 | B2 | 8/2020 | Kah, Jr. | |
| 10,857,550 | B2 | 12/2020 | Huntley | |
| 2006/0130447 | A1 | 6/2006 | Seo et al. | |
| 2006/0130448 | A1 | 6/2006 | Han et al. | |
| 2006/0130449 | A1 | 6/2006 | Han et al. | |
| 2006/0288671 | A1 | 12/2006 | Oh et al. | |
| 2010/0132317 | A1 | 6/2010 | Thien | |
| 2010/0192980 | A1 | 8/2010 | Turner | |
| 2019/0357745 | A1 | 11/2019 | Zhu et al. | |
| 2021/0053075 | A1 | 2/2021 | Huntley | |

FOREIGN PATENT DOCUMENTS

| | | | |
|---|---|---|---|
| CN | 102885600 | A | 1/2013 |
| CN | 202859029 | U | 4/2013 |
| CN | 203138360 | U | 8/2013 |
| CN | 203138362 | U | 8/2013 |
| CN | 204862986 | U | 12/2015 |
| CN | 205054024 | U | 3/2016 |
| CN | 108720726 | A | 11/2018 |
| CN | 109091066 | A | 12/2018 |
| CN | 208435487 | U | 1/2019 |
| CN | 208740860 | U | 4/2019 |
| CN | 208988709 | U | 6/2019 |
| CN | 209186567 | U | 8/2019 |
| CN | 209220120 | U | 8/2019 |
| CN | 209269566 | U | 8/2019 |
| CN | 210643878 | U | 6/2020 |
| EP | 1535560 | B1 | 3/2013 |
| EP | 2292130 | B1 | 11/2014 |
| WO | 2008070962 | A1 | 6/2008 |
| WO | 2008070972 | A1 | 6/2008 |
| WO | 2011050637 | A1 | 5/2011 |
| WO | 2011132323 | A1 | 10/2011 |
| WO | 2016170431 | A1 | 10/2016 |
| WO | 2020024535 | A1 | 2/2020 |

* cited by examiner

INTEGRATED CYCLONIC SEPARATOR IN A WET-DRY VACUUM

CROSS-REFERENCE TO RELATED APPLICATIONS

This application claims priority to U.S. Provisional Patent Application No. 63/153,793 filed Feb. 25, 2021, the entire contents of which are incorporated herein by reference.

FIELD

The present disclosure relates to vacuum cleaners. More particularly, the present disclosure relates to cyclonic separators for vacuum cleaners.

BACKGROUND

Vacuum cleaners, such as shop floor or job site type vacuum cleaners, are typically useable for dry and wet extraction. Some known wet-dry vacuums include one or more filter assemblies upstream of a suction motor to protect the motor from the extracted dust, debris, and/or liquid. In some instances, wet-dry vacuums may lose suction force as the filer becomes clogged with debris.

SUMMARY

One example embodiment of the present disclosure provides a wet-dry vacuum cleaner including a collecting bin, a cyclonic separator removably coupled to the bin, the cyclonic separator including a dirty air inlet and a clean air outlet, a housing removably coupled to the cyclonic separator, the housing supporting a filter therein, the filter positioned adjacent the clean air outlet of the cyclonic separator when the housing is coupled to the cyclonic separator, a power head integrally formed on the housing, the power head including an exhaust outlet, and a suction motor assembly operable to create a working airflow path from the dirty air inlet, through the cyclonic separator, through the clean air outlet, and to the exhaust outlet. The cyclonic separator is configured to separate heavier debris from the working airflow and discharge the separated heavier debris into the collecting bin.

Another example embodiment of the present disclosure provides a wet-dry vacuum cleaner including a collecting bin, and a power head removably coupled to the collecting bin. The power head includes a housing configured to support the power head on the collecting bin, an exhaust outlet, a cyclonic separator positioned within the housing, the cyclonic separator including a dirty air inlet, a chamber, and a clean air outlet, a suction motor assembly operable to create a working airflow path from the dirty air inlet to the exhaust outlet, and a filter disposed within a filter housing hanging downwardly from the suction motor assembly, the filter positioned within the working airflow path adjacent the clean air outlet of the cyclonic separator.

Yet another example embodiment of the present disclosure provides a wet-dry vacuum cleaner including a collecting bin and a power head removably coupled to the collecting bin, the power head including a housing configured to support the power head on the collecting bin, dirty air inlet, an exhaust outlet, and a suction motor assembly operable to draw working air from the dirty air inlet and expel air through exhaust outlet. The wet-dry vacuum cleaner further including a cyclonic separator integrated within the housing, the cyclonic separator including a plate configured to separate heavier debris from the working air, the plate having an opening defined between the plate and the housing of the power head, the opening allowing heavier debris to fall in to the collecting bin, and a clean air outlet positioned within the housing of the power head, the clean air outlet configured to receive working air unladen of heavier debris. The wet-dry vacuum cleaner even further includes a filter housing hanging downwardly from the power head, the filter housing receiving air from the clean air outlet of the cyclonic separator, a filter supported within the filter housing, the filter being disposed fluidly downstream of the cyclonic separator, and a conduit extending from the filter toward the exhaust outlet, the conduit positioned physically in the cyclonic separator but fluidly disposed downstream of the cyclonic separator. The conduit physically separates working air entering into the filter housing though the clean air outlet and working air exiting the filter housing through the conduit.

Other features and aspects of the disclosure will become apparent by consideration of the detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

DETAILED DESCRIPTION

Figure 1:
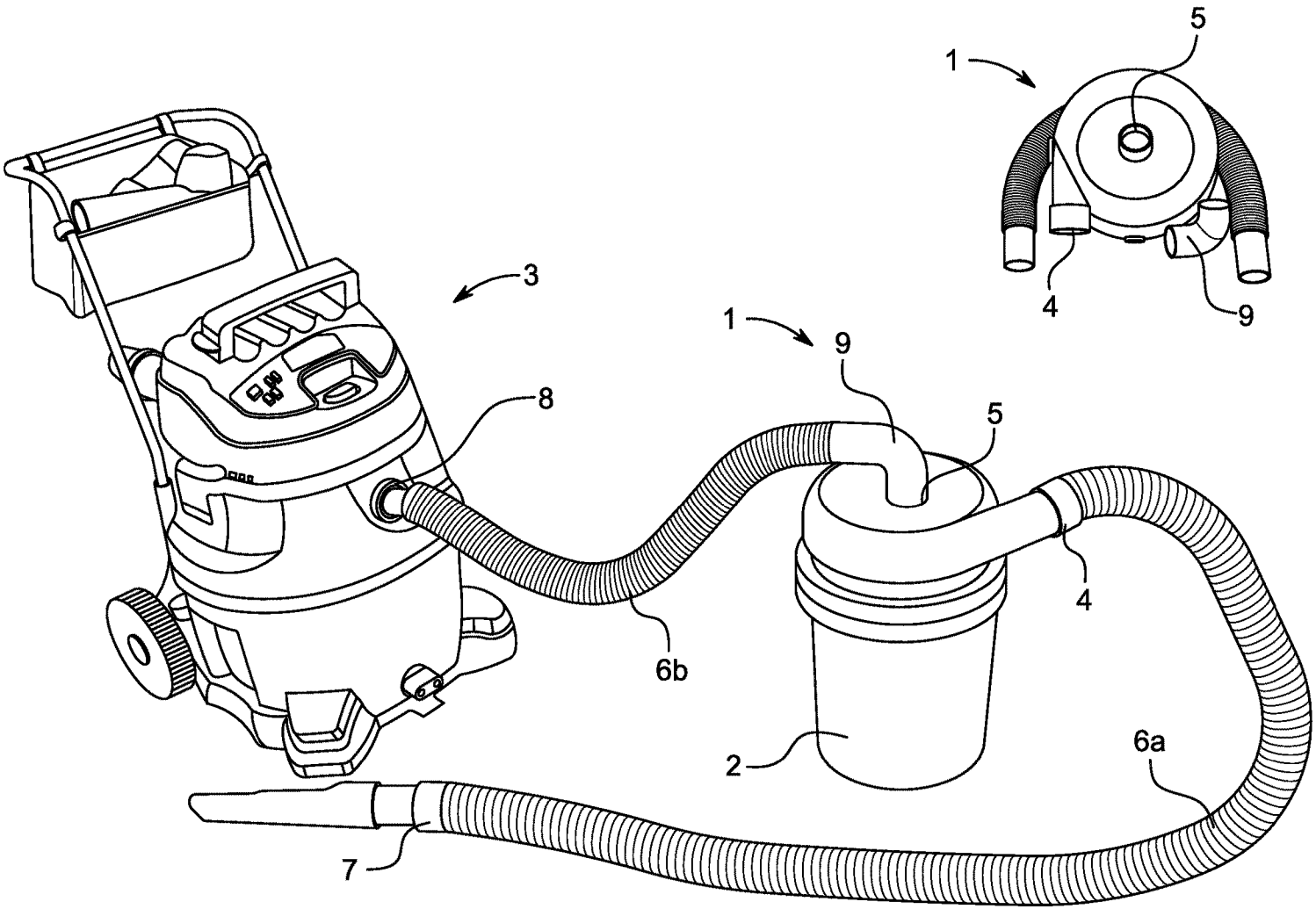
FIG. 1 PRIOR ART
FIG. 1 is a perspective view of a known cleaning system, including a wet-dry vacuum cleaner and a prior art cyclonic separator system disposed separately of the wet-dry vacuum, illustrating the cyclonic separator system coupled to a collecting bucket and disposed upstream of the wet-dry vacuum cleaner.

FIG. 1 illustrates a prior art example of a cyclonic separator 1 that couples with a utility bucket 2 (e.g., cannister, bin, five gallon pale, etc.) and is disposed separate and upstream of a wet-dry vacuum cleaner 3. The cyclonic separator 1 includes a dirty air inlet port 4 and a clean air outlet port 5 at the top center of the cyclonic separator 1. The dirty air inlet port 4 is fluidly coupled to a first flexible hose 6*a* with an opposite free or suction end 7, and the clean air outlet port 5 is fluidly coupled to a second flexible hose 6*b* with an opposite end fluidly coupled to an inlet port 8 on the wet-dry vacuum cleaner 3. In operation, the wet-dry vacuum cleaner 3 is turned on, and a suction motor operates to draw in dirty air from the suction end 7 of the first flexible hose 6*a*. The dirty air passes through the cyclonic separator 1 where the air spins causing relatively heavier debris to separate from the airstream and collect in the utility bucket 2. The airflow then passes out of the clean air outlet port 5 to the second flexible hose 6*b* and into the wet-dry vacuum cleaner 3 through the inlet port 8. The clean air outlet port 5 may further support an elbow connection 9 coupled between the clean air outlet port 5 and the second flexible hose 6*b*.

Figure 2B:
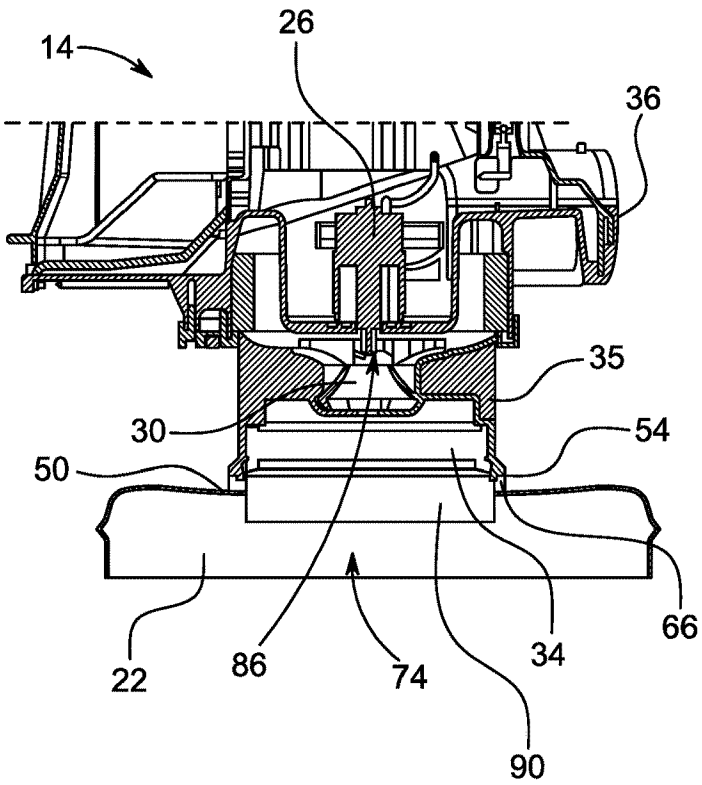
FIG. 2B is a cross-sectional view of a portion of the cleaning system of FIG. 2A, taken along section line 2B-2B of FIG. 2A.
Figure 2A:
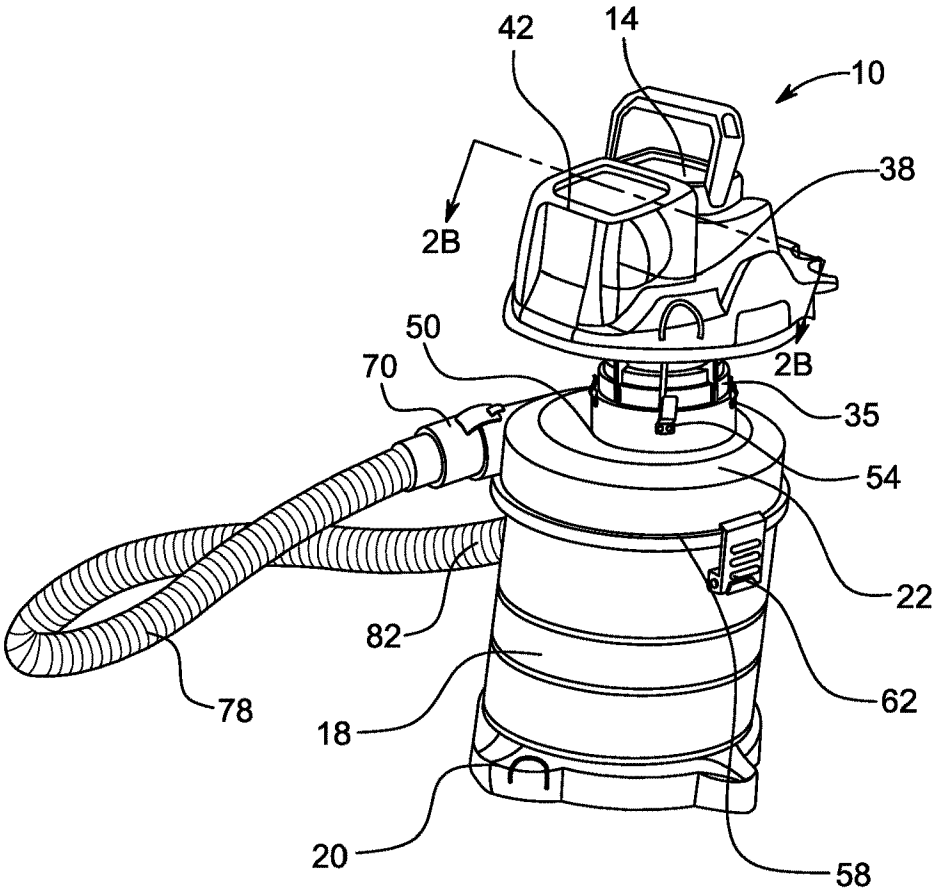
FIG. 2A is a perspective view of a cleaning system, according to an embodiment of the disclosure, illustrating a cyclonic separator that is integrated with a wet-dry vacuum cleaner.

FIGS. 2A and 2B illustrate a wet-dry vacuum cleaner 10, according to an embodiment of the present disclosure. The wet-dry vacuum cleaner 10 includes a power head 14, a bin 18 (e.g., a collecting bin, debris cannister, bucket, etc.), and a cyclonic separator 22 integrated with the wet-dry vacuum cleaner 10 between the power head 14 and the bin 18. In some embodiments, the bin 18 can be received by a base 20, such as an elevating base, a rolling base, and/or the like. The power head 14 incudes a suction motor 26 energized to rotate a fan 30, such as an impeller, and generate a suction airflow through a portion of the power head 14. The power head 14 further includes a pre-motor filter 34 that hangs downward from the power head 14 adjacent the suction motor 26 and fan 30. The pre-motor filter 34 is supported in a pre-motor filter housing 35 that further supports the power head 14 on the bin 18. The suction airflow, from the bin 18, travels through the pre-motor filter 34 before moving across the fan 30 and exhausting through an outlet port 36 on the power head 14.

The power head 14 also includes a power source 38. In the illustrated embodiment, the power source 38 includes a DC source, such as a removable or integrated battery. As shown in FIG. 2A, the power source 38 may be received beneath a cover 42 pivotally coupled to the power head 14. In other embodiments, an AC power source, such as a wall outlet, may be utilized to power the power head 14. In some embodiments, a combination of AC and DC power may be used to power the power head 14, suction motor 26, or the like.

Referring to FIGS. 2A-6, the power head 14 is supported on the pre-motor filter housing 35, which is attachable to an upper rim 50 of the cyclonic separator 22 via a plurality of latches 54 to connect the power head 14 to the cyclonic separator 22. The cyclonic separator 22 is in turn attached to an upper rim 58 of the bin 18 by latches 62 (e.g., over-center-type latches), such that the cyclonic separator 22 is disposed between the upper rim 58 of the bin 18 and a lower edge 66 (FIG. 2B) of the pre-motor filter housing 35. In other words, the power head 14 is connected to the bin 18 through the cyclonic separator 22 and through the pre-motor filter housing 35. In instances where the wet-dry vacuum cleaner 10 is operated without the cyclonic separator 22, the latches 62 may connect the power head 14 directly to the bin 18, and the bin 18 may include an inlet similar to the dirty air inlet port 70 on the cyclonic separator 22. In such instance, the pre-motor filter housing 35 is received directly in the bin 18 and the latches 54 on the pre-motor filter housing 35 sit freely in an unlatched position.

With specific reference to FIG. 2A, the cyclonic separator 22 includes a dirty air inlet port 70 and a clean air outlet port 74 at the top center of the cyclonic separator 22. The dirty air inlet port 70 is fluidly coupled to a flexible hose 78 with an opposite free or suction end 82, and the clean air outlet port 74 is fluidly coupled to an inlet port 86 on the power head 14 through the pre-motor filter housing 35.

The cyclonic separator 22 can be an integrated component of the wet-dry vacuum cleaner 10 or could be a separately sold component (e.g., after market part or accessory) that can be added to a typical wet-dry vacuum cleaner to increase an effectiveness (e.g., suction force, operating strength, etc.) of dirt separation by removing the power head 14 from the bin 18 and inserting the cyclonic separator 22 between the bin 18 and the power head 14 in a stacked configuration, as illustrated in FIG. 2B. In some embodiments, the cyclonic separator 22 may be omitted such that the wet-dry vacuum cleaner 10 could be selectively operable like a typical wet-dry vacuum cleaner without the cyclonic separator 22 or operable with the cyclonic separator 22.

In operation, the wet-dry vacuum cleaner 10 can be turned on (e.g., energized) to operate the suction motor 26 and draw dirty air into the cyclonic separator 22 from the free or suction end 82 of the flexible hose 78. The dirty air passes through the cyclonic separator 22 where the air spins and causes relatively heavier debris to separate from an airstream and collect in the bin 18. The airflow then passes radially inwardly through a centrally-located cylindrical screen 90, up through the clean air outlet port 74, through the pre-motor filter 34, and out of the power head 14 through the outlet port 36. In some embodiments, the airflow passes through the centrally-located cylindrical screen 90 and above a float assembly before passing through the clean air outlet port 74 and pre-motor filter 34. In the illustrated embodiment, the airflow passes substantially vertically from the cyclonic separator 22, through the clean air outlet port 74, through the pre-motor filter 34, and through the fan 30. In other words, the airflow path from the cyclonic separator 22 into the power head 14 is principally vertical.

Figure 3:
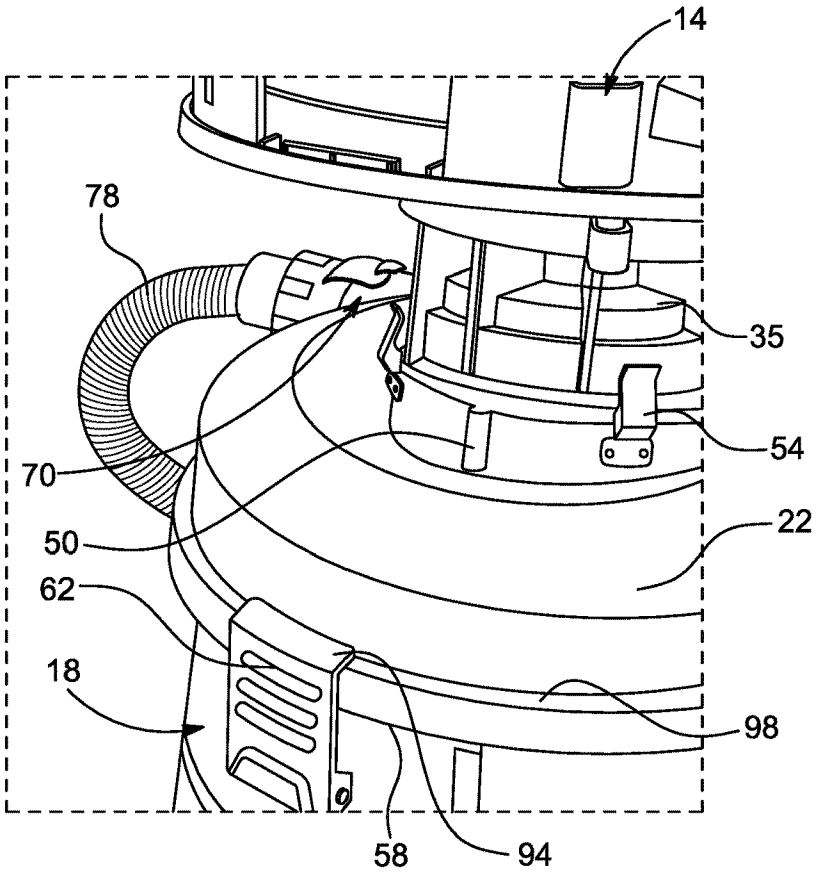
FIG. 3 is an enlarged perspective view of the wet-dry vacuum and cyclonic separator of FIG. 2A, illustrating the cyclonic separator connected between a power head and a collecting bin.

FIG. 3 illustrates the wet-dry vacuum cleaner 10 with the cyclonic separator 22 connected between the power head 14 and the 18. More specifically, the latches 54 between the pre-motor filter housing 35 and the cyclonic separator 22 are positioned in a latched position in which the power head 14 is stacked on the cyclonic separator 22 and connected to the cyclonic separator 22. FIG. 3 further illustrates the latches 62 between the cyclonic separator 22 and the bin 18 in a latched position in which the cyclonic separator 22 is stacked on the bin 18 and connected to the bin 18 via the latches 62.

As shown in FIG. 3, the latches 54 between the pre-motor filter housing 35 and the cyclonic separator 22 may be metal clasp-type latches. In other embodiments, other types of connectors may be used to attach the cyclonic separator 22 to the pre-motor filter housing 35, such as a threaded twist connection, bayonet connection, a stacking interface, a detent mechanism, and/or the like. As also shown in FIG. 3, the latches 62 between the cyclonic separator 22 and the bin 18 are moveably mounted to the bin 18 and may be over-center-type latches or another type of connector. In some embodiments, the latches 62 are moveably mounted to the cyclonic separator 22 and latched to the bin 18. When latched, a lip 94 on the latches 62 extends over a complementary edge 98 on the cyclonic separator 22, and the lip 94 is set to a stop position in which the latches 62 remains biased in the latched position.

Figure 4:
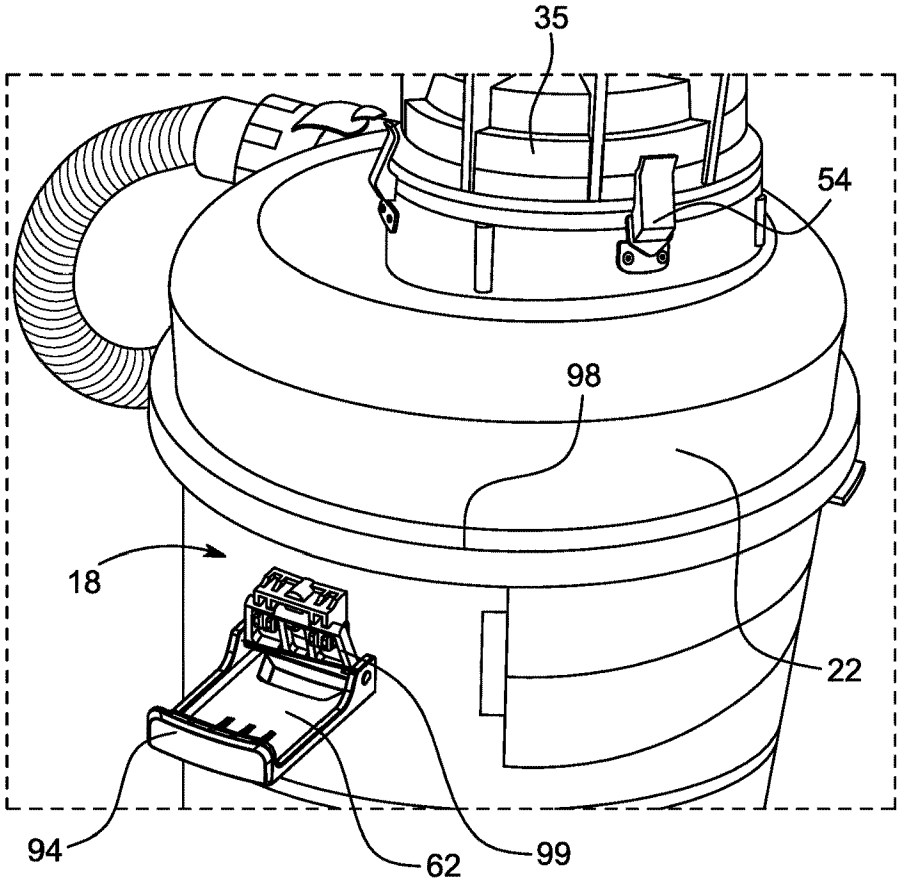
FIG. 4 is another enlarged perspective view of the wet-dry vacuum and cyclonic separator of FIG. 2A, illustrating a latch between the cyclonic separator and the collecting bin in an unlatched position.

When unlatched, as illustrated in FIG. 4, the latches 62 between the cyclonic separator 22 and the bin 18 are opened such that the lip 94 does not extend over the complementary edge 98 and the lip 94 is not biased to the stop position. Rather, when unlatched, the lip 94 generally sits freely. In other embodiments, the lip 94 may be temporarily biased into the unlatched position once an unlocking or opening force is applied to the latches 62. As further illustrated in FIG. 4, the latches 62 include a hinge assembly 99 that may accommodate biasing of the latches 62 in the locked/latched position (FIG. 3).

Figure 6:
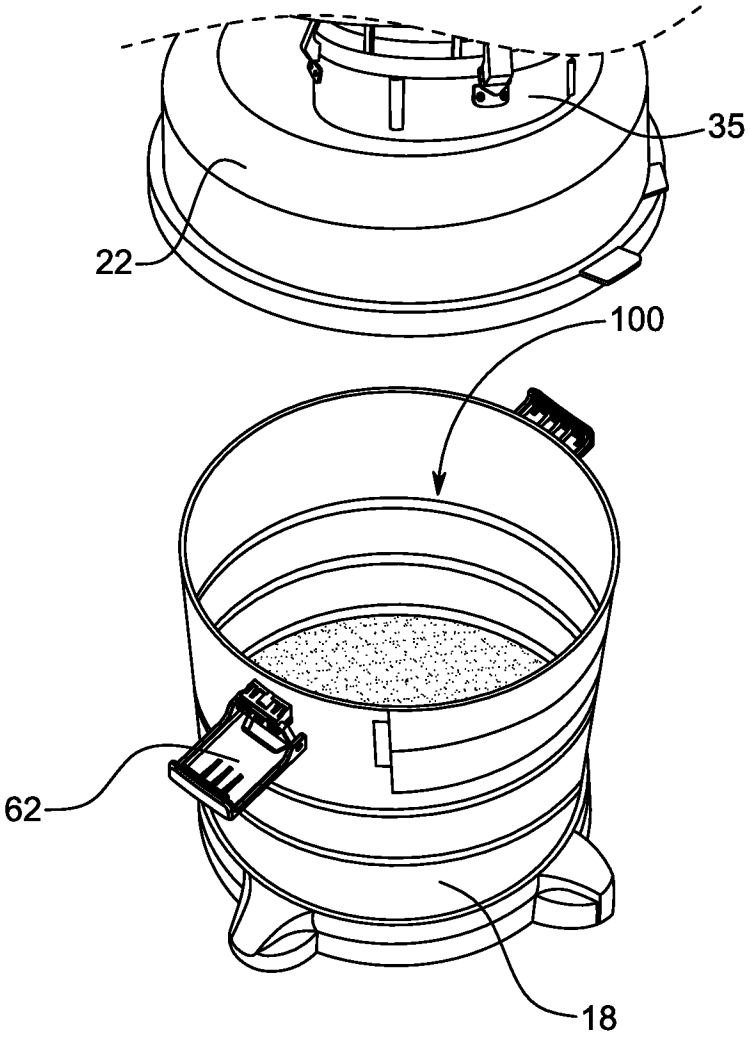
FIG. 6 is a perspective view of the wet-dry vacuum and cyclonic separator of FIG. 2A, illustrating the collecting bucket poised to have debris separated by the cyclonic separator removed from the collecting bin.
Figure 5:
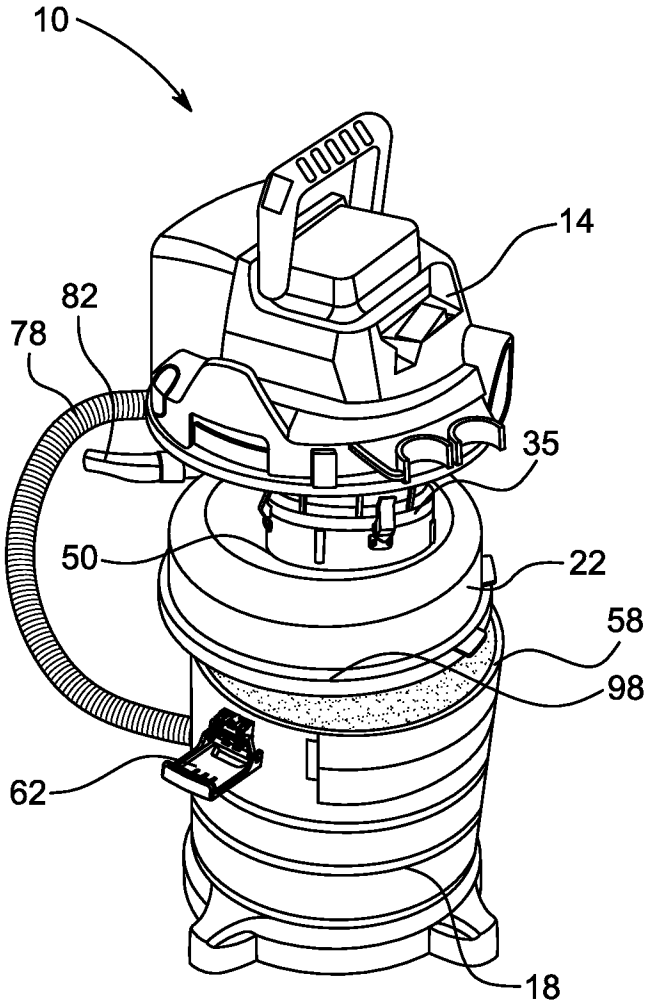
FIG. 5 is a perspective view of the wet-dry vacuum and cyclonic separator of FIG. 2A, illustrating the latch in the unlatched position, and illustrating the cyclonic separator and the power head being lifted off and away from the collecting bin.

When unlatched, as also illustrated in FIGS. 5 and 6, the latches 62 between the cyclonic separator 22 and the bin 18 are opened such that the cyclonic separator 22 is removable from the bin 18. FIG. 5 further illustrates the power head 14, pre-motor filter housing 35, and cyclonic separator 22 being lifted away from the bin 18, while FIG. 6 further illustrates the power head 14, pre-motor filter housing 35, and cyclonic separator 22 totally lifted away from the bin 18 to expose a collection chamber 100 within the bin 18.

As described above, the heavier debris (e.g., stones, wood scrap, metal pieces, sand, etc.) separated from the airstream within the cyclonic separator 22 falls from the airstream and into the bin 18, and the remaining airstream proceeds upstream to the pre-motor filter 34. When the cyclonic separator 22 is attached to the bin 18, the larger or heavier debris is collected within the collection chamber 100 in the bin 18. While in the totally lifted away position shown in FIG. 6, the debris may be removed from the bin 18 to empty out the collection chamber 100.

Figure 7:
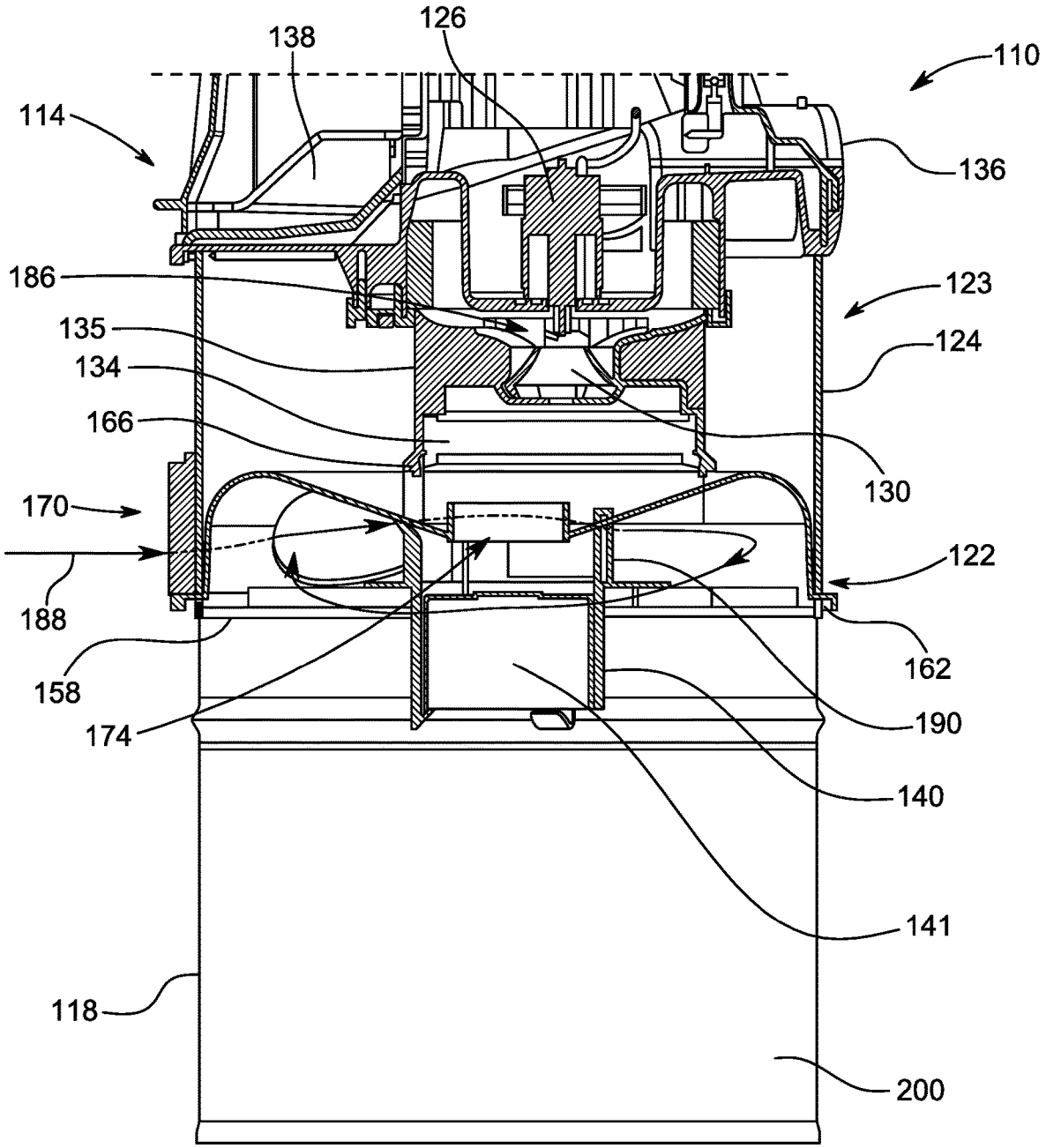
FIG. 7 is a cross-sectional view of a cleaning system, according to another embodiment of the disclosure, illustrating a wet-dry vacuum and cyclonic separator that is integrated with a power head of the wet-dry vacuum cleaner.
Figure 8B:
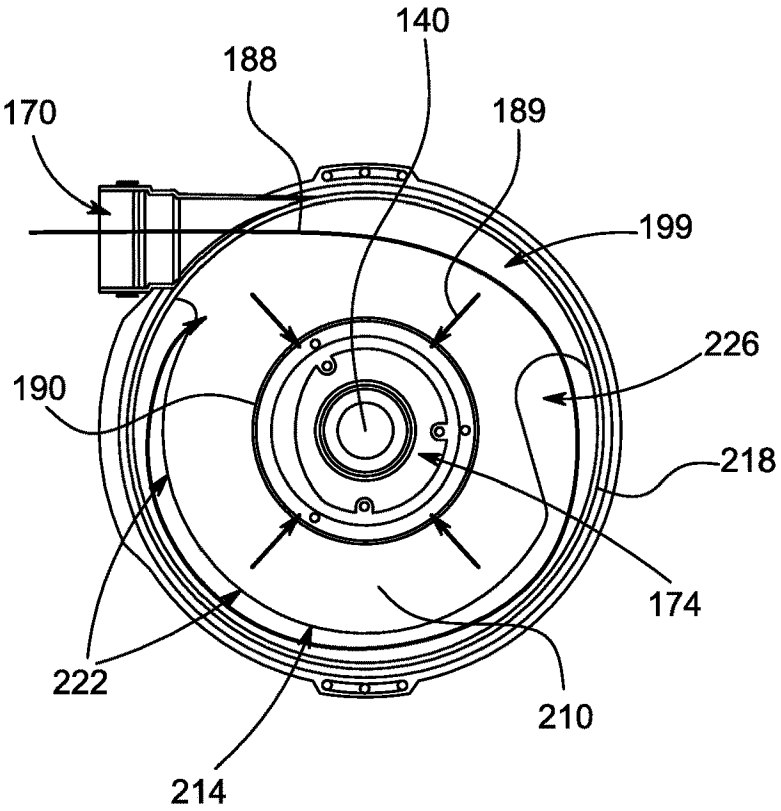
FIG. 8B is an upper view of FIG. 8A, illustrating a separating plate and the airflow of the cyclonic separator.

FIGS. 7-8B illustrate a wet-dry vacuum cleaner 110, according to another embodiment of the present disclosure. The wet-dry vacuum cleaner 110 of FIGS. 7-8B is similar to the wet-dry vacuum cleaner 10 described above with reference to FIGS. 2A-6, and similar aspects of the wet-dry vacuum cleaner 110 are identified with similar reference numbers, plus "100." Some of the differences between the wet-dry vacuum cleaner 10 and the wet-dry vacuum cleaner 110 are described.

Referring to FIG. 7, the wet-dry vacuum cleaner 110 includes a power head 114, a bin 118 (e.g., a collecting bin, debris cannister, bucket, etc.), and a cyclonic separator 122 integrated with the wet-dry vacuum cleaner 110 and within the power head 114. As illustrated in FIG. 7, the cyclonic separator 122 is connected directly to the power head 114 and surrounds a pre-motor filter housing 135 supporting a pre-motor filter 134. The power head 114 and cyclonic separator 122 are further collectively attached to the bin 118.

The power head 114 further incudes a housing 123 having an outer wall 124 that streamlines a transition from the cyclonic separator 122 and through the power head 114. As best shown in FIG. 7, the outer wall 124 and housing 123 further houses the cyclonic separator 122 within the power head 114. The power head 114 further incudes a suction motor 126 energized to rotate a fan 130, such as an impeller, and generate a working or suction airflow through a portion of the power head 114. The pre-motor filter 134 is supported in the power head 114 and hangs downward adjacent the suction motor 126 and fan 130. The pre-motor filter 134 is supported in the pre-motor filter housing 135 that fluidly connects with the cyclonic separator 122 and extends to the suction motor 126. The working airflow travels through the cyclonic separator 122, through a clean air outlet port 174 in the cyclonic separator 122, and into the pre-motor filter 134 before moving across the fan 130 and exhausting through an outlet port 136 on the power head 114. In the illustrated embodiment, the clean air outlet port 174 is centrally located on the cyclonic separator 122 and is surrounded by a centrally-located cylindrical screen assembly 190.

FIG. 7 further illustrates a float assembly 140 centrally lower than the clean air outlet port 174 of the cyclonic separator 122. The float assembly 140 includes a float puck 141 that will close off the clean air outlet port 174 when a liquid (e.g., fluid, water, and/or the like) level within the bin 118 reaches a predetermined height, such as a max height, full level, and/or the like. Stated another way, the float puck 141 sits in a dropped position (FIG. 7) until the liquid reaches a surface of the float puck 141 and raises the float puck 141 into a blocking position in which the float puck 141 closes off the clean air outlet port 174. As the liquid level continues to rise, the float puck 141 will raise with the fluid level until the fluid level is high enough to bear the float puck 141 against the clean air outlet port 174. Once the float puck 141 is high enough (e.g., in the blocking position), the float puck 141 will inhibit liquid from passing out of the bin 118 and into the clean air outlet port 174 toward the suction motor 126. The float puck 141 may also close off the clean air outlet port 174 to halt operation of the suction motor 126. In such instances, the suction motor 126 may communicate with a sensor, trigger, and/or the like and receive a command to deenergize (e.g., shut off, halt rotation of the fan 130, etc.).

The power head 114 also includes a power source 138 similar to the power source(s) 38 of the wet-dry vacuum cleaner 10. Referring still to FIG. 7, the power head 114 is supported on the housing 123, and the cyclonic separator 122 is integrally formed with the housing 123 to connect and fluidly communicate the bin 118 with the suction motor 126. In some embodiments, the power head 114 is integrally connected to the housing 123. In other embodiments, the power head 114 is removably coupled to the housing 123, including the cyclonic separator 122, and the housing 123 is in turn removably coupled to an upper rim 158 of the bin 118 by latches 162 (e.g., over-center-type latches, snap latches, etc.), such that the cyclonic separator 122 is disposed between the upper rim 158 of the bin 118 and a lower edge 166 of the pre-motor filter housing 135. In other words, the power head 114 is connected to the bin 118 through the housing 123, and the cyclonic separator 122 and pre-motor filter housing 135 are fully integrated into the power head 114.

Figure 8A:
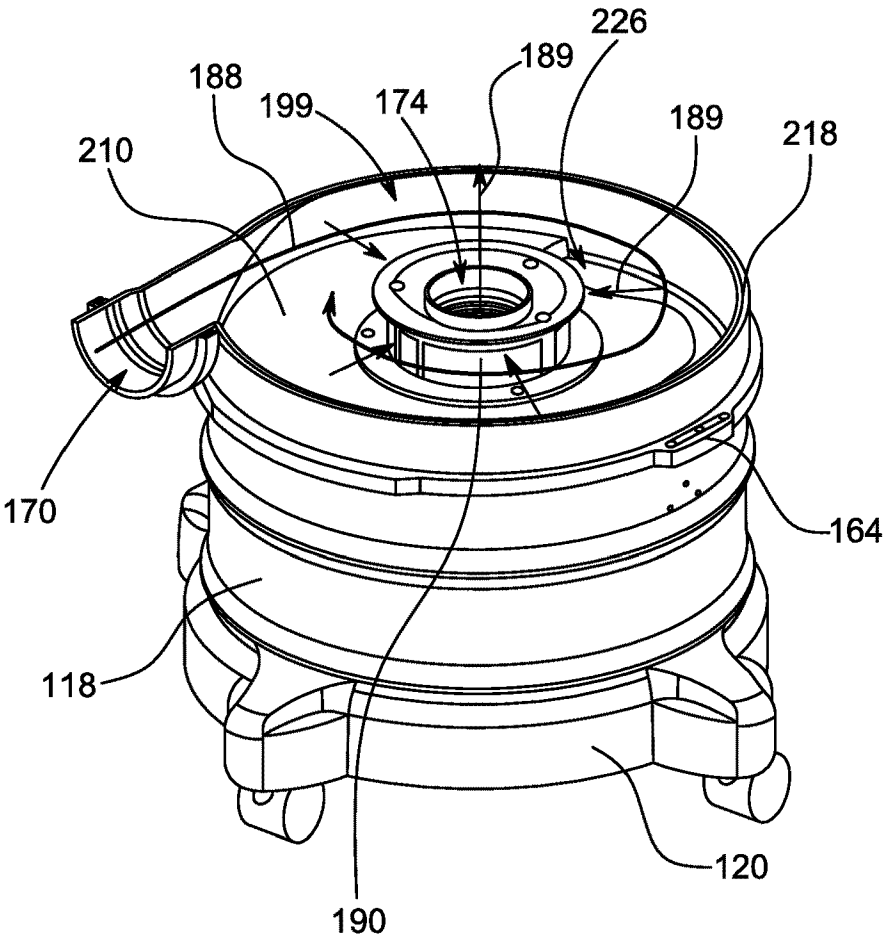
FIG. 8A is a partial cross-sectional view horizontally through the cyclonic separator of FIG. 7, illustrating an inlet port and airflow of the cyclonic separator.

Referring now to FIGS. 7, 8A, and 8B, the cyclonic separator 122 includes a dirty air inlet port 170 and the clean air outlet port 174 at the top center of the cyclonic separator 122. The dirty air inlet port 170 may be fluidly coupled to a flexible hose (e.g., flexible hose 78 of FIG. 2A) with an opposite free or suction end, and the clean air outlet port 174 is fluidly coupled to a suction motor housing inlet port 186 on the power head 114 through the pre-motor filter housing 135, including the fan 130 and pre-motor filter 134.

In the illustrated embodiment, the cyclonic separator 122 may be referred to as an integrated component of the wet-dry vacuum cleaner 110 that increases an effectiveness (e.g., suction force, operating strength, etc.) of dirt separation accomplished by the power head 114 by decreasing an amount of debris that travels to the pre-motor filter 134, thus allowing for more air to flow through the pre-motor filter 134 and to the suction motor 126. In some embodiments, the power head 114 is sealable to the bin 118 by a bayonet connection and/or a snap-fit connection 164, in which a portion of the cyclonic separator 122 is open to the bin 118. In other embodiments, the housing 123 forms a half or clamshell portion of the cyclonic separator 122, and a portion of the housing 123 is connectable with the cyclonic separator 122 and the bin 118.

In operation, the wet-dry vacuum cleaner 110 can be turned on (e.g., energized) to operate the suction motor 126 and draw a dirty air 188 into the cyclonic separator 122 through the dirty air inlet port 170. As best shown in FIGS. 8A and 8B, dirty air 188 coming into the power head 114 will enter tangentially into a cyclonic chamber 199 of the cyclonic separator 122 and cause the dirty air 188 to spin cyclonically within the cyclonic chamber 199. The cyclonic separator 122 further causes the relatively heavier debris (e.g., dirty liquid droplets, dirt, stones, wood scrap, metal pieces, sand, etc.) to be forced radially outwardly relative the clean air outlet port 174, thereby separating the heavier debris from the dirty air 188 and resulting in clean air 189 moving through the clean air outlet port 174.

It should be stated that the clean air 189 refers to the working airflow that does not include the heavier debris described above. The clean air 189 will still pass through the centrally-located cylindrical screen assembly 190 with working airflow laden with lighter debris (e.g., dust, particles, fine grains, etc.). However, it should be understood that the lighter debris will be separated from the clean air 189 by the pre-motor filter 134 such that the working airflow passing over/adjacent the suction motor 126 does not damage the suction motor 126.

With continued reference to FIGS. 7, 8A, and 8B, the separated heavier debris will fall into a collection chamber 200 (FIG. 7) of the bin 118 through a plate 210 positioned at least partially within the cyclonic chamber 199 and supported by the cyclonic separator 122. The plate 210 includes a cutout 214 positioned between a defining wall 218 of the cyclonic chamber 199 and a portion of the plate 210. The defining wall 218 may be an outer or even outermost wall of the cyclonic separator 122. The defining wall 218 may, in some embodiments, align with the outer wall 124 of the power head 114, and may further define at least a portion of the cyclonical airflow path.

In the illustrated embodiment, the cutout 214 includes an opening 222 extending along the defining wall 218 and a larger relief opening 226 that terminates the opening 222. As shown in FIG. 8B, the opening 222 is generally arcuate. In other embodiments, the cutout 214 includes an opening having a different shape. In general, the opening accommodates separation of the heavier debris and allows the heavier debris to fall from the dirty air 188 and into the collection chamber 200. The larger relief opening 226 may be positioned anywhere along the cutout 214 but is illustrated as being disposed in a radial airflow path of the dirty air 188 and upstream of the remainder of the cutout 214 and/or opening 222.

As illustrated in FIG. 8B, the cutout 214 extends around more than 50% (e.g., approximately 65%) of an entire radial surface of the defining wall 218. In some embodiments, the cutout 214 extends around more than 75% (e.g., approximately 85%) of the entire radial surface of the defining wall 218. In other embodiments, the cutout 214 extends around more than 95% (e.g., approximately 100%) of the entire radial surface of the defining wall 218. In yet another embodiment, the cutout 214 extends around less than 50% (e.g., approximately 30%) of the entire radial surface of the defining wall 218, while in even another embodiment, the cutout 214 extends around less than 25% (e.g., approximately 10%) of the entire radial surface of the defining wall 218. In such embodiments in which the cutout 214 extends around less than 25% of the entire radial surface of the defining wall 218, the cutout 214 may be made up of primarily the larger relief opening 226.

After the heavier debris is separated from the dirty air 188, the resulting clean air 189 will then move radially inwardly toward the clean air outlet port 174 and float assembly 140. The clean air 189 will pass through the centrally-located cylindrical screen assembly 190 and travel up through the clean air outlet port 174 of the cyclonic separator 122 and toward the pre-motor filter 134 of the power head 114. From there, the clean air 189 will be substantially void of lighter debris and the "filtered" working air will pass through the fan 130 and be exhausted from the power head 114 through the outlet port 136.

In some embodiments, the outlet port 136 includes one or more exhaust vents. The working airflow travels through the cyclonic separator 122, through the clean air outlet port 174 in the cyclonic separator 122, and into the pre-motor filter 134 before moving across the fan 130 and exhausting through the outlet port 136 on the power head 114. As further illustrated in FIG. 8A, the bin 118 can be received by a base 120, such as an elevating base, a rolling base, and/or the like.

Figure 9:
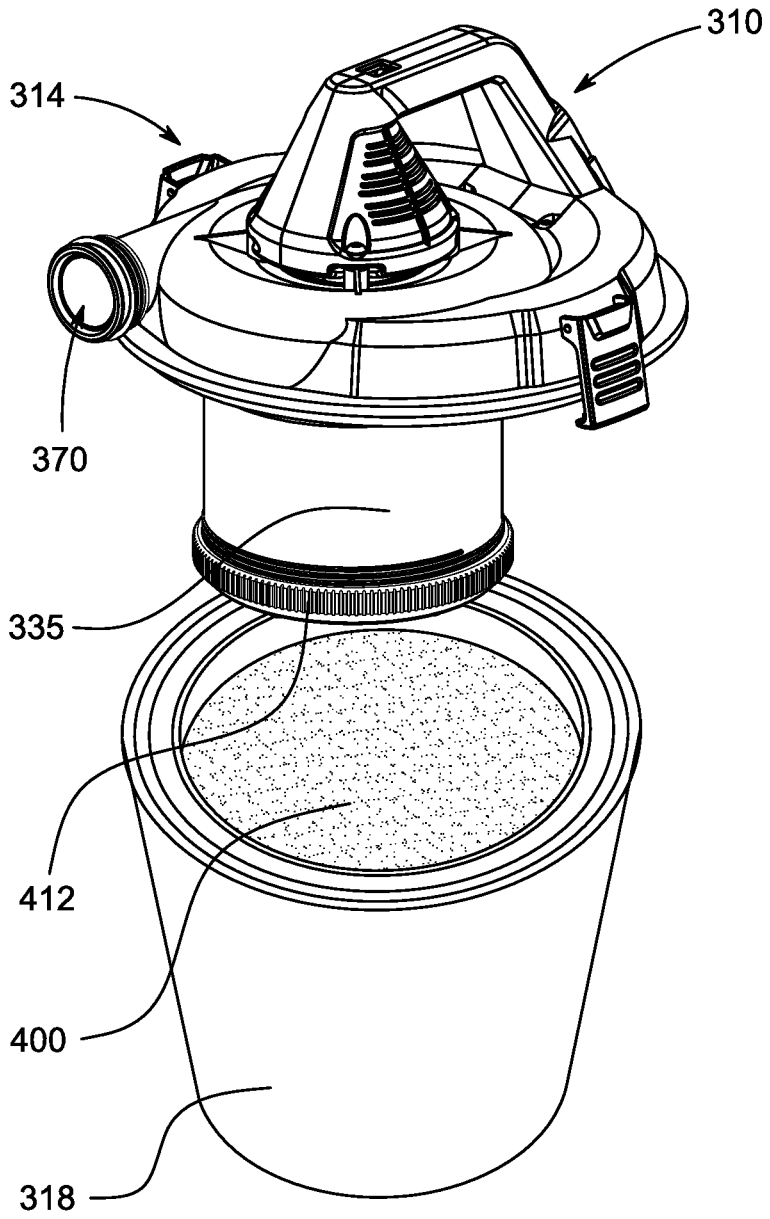
FIG. 9 is a perspective view a cleaning system, according to another embodiment of the disclosure, illustrating a wet-dry vacuum and cyclonic separator that is integrated with a power head of the wet-dry vacuum cleaner.
Figure 10:
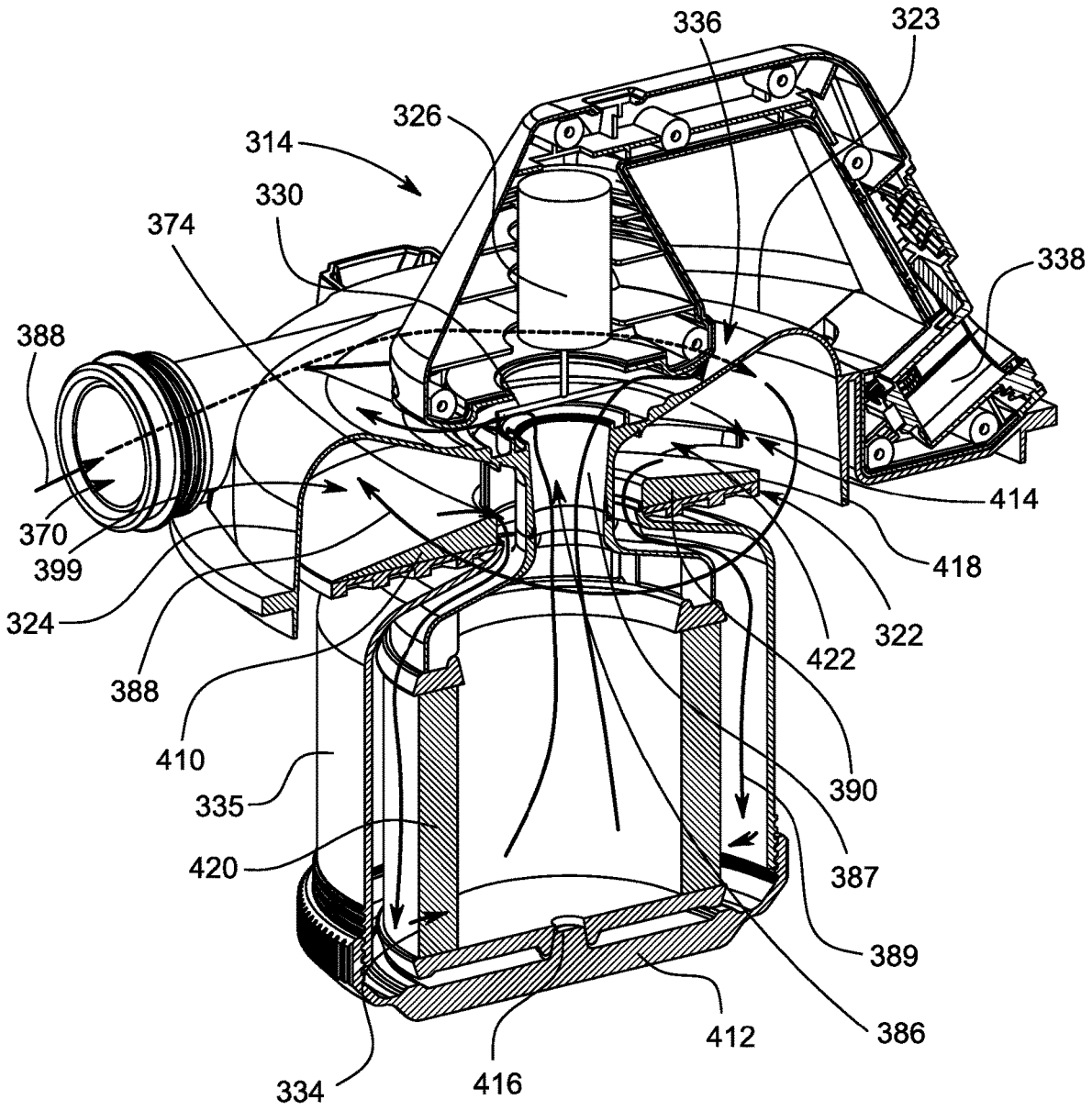
FIG. 10 is a perspective cross-sectional view of the wet-dry vacuum cleaner of FIG. 9, taken through section line 10-10 of FIG. 9.

FIGS. 9 and 10 illustrate a wet-dry vacuum cleaner 310, according to another embodiment of the present disclosure. The wet-dry vacuum cleaner 310 of FIGS. 9 and 10 is similar to the wet-dry vacuum cleaner 110 described above with reference to FIGS. 7-8B, and similar aspects of the wet-dry vacuum cleaner 310 are identified with similar reference numbers, plus "200." It should be understood that the wet-dry vacuum cleaner 310 is also inherently similar to the wet-dry vacuum cleaner 10 described above with reference to FIGS. 2A-6. Some of the differences between the wet-dry vacuum cleaner 110 and the wet-dry vacuum cleaner 310 are described.

Referring to FIG. 9, the wet-dry vacuum cleaner 310 includes a power head 314, a bin 318 (e.g., a collecting bin, debris cannister, bucket, etc.), and a cyclonic separator 322 integrated with the wet-dry vacuum cleaner 310 and within the power head 314. As illustrated in FIG. 10, the cyclonic separator 322 is disposed directly within the power head 314 and surrounds a pre-motor filter housing 335 supporting a pre-motor filter 334. The power head 314, including the cyclonic separator 322, can be selectively attached to the bin 318.

The power head 314 further incudes a housing 323 having an outer wall 324 that streamlines a transition from the cyclonic separator 322 and through the power head 314. As best shown in FIG. 10, the outer wall 324 and housing 323 further houses the cyclonic separator 322 within the power head 314. The power head 314 further incudes a suction motor 326 energized to rotate a fan 330, such as an impeller, and generate a working or suction airflow through a portion of the power head 314. The pre-motor filter 334 is supported in the power head 314 and hangs downward adjacent the suction motor 326 and fan 330. The pre-motor filter 334 is supported in the pre-motor filter housing 335, which is fluidly connected with the cyclonic separator 322 and extends to the suction motor 326.

Generally, working airflow travels through the cyclonic separator 322, through a clean air outlet port 374 in the cyclonic separator 322, and into the pre-motor filter 334 before moving across the fan 330 and exhausting through an outlet port 336 on the power head 314. In some embodiments, the outlet port 336 allows air to exhaust radially outwardly. In the illustrated embodiment, the clean air outlet port 374 is centrally located on the cyclonic separator 322 and extends into the pre-motor filter housing 335. In some embodiments, the wet-dry vacuum cleaner 310 includes a float assembly that will close off the clean air outlet port 374 when a liquid (e.g., fluid, water, and/or the like) level within the bin 318 reaches a predetermined height, such as a max height, full level, and/or the like.

The power head 314 also includes a power source 338 similar to the power source(s) 38, 138 of the wet-dry vacuum cleaner 10, 110.

Referring still to FIG. 10, the cyclonic separator 322 includes a dirty air inlet port 370 and the clean air outlet port 374 at the top center of the cyclonic separator 322. The dirty air inlet port 370 may be fluidly coupled to a flexible hose (e.g., flexible hose 78 of FIG. 2A) with an opposite free or suction end, and the clean air outlet port 374 is fluidly coupled to a suction motor housing inlet port 386 in the power head 314 through the pre-motor filter housing 335, including the fan 330 and pre-motor filter 334. In the illustrated embodiment, the pre-motor filter 334 to the suction motor housing inlet port 386 are fluidly connected by a conduit 387. In some embodiments, the clean air outlet port 374 at least partially surrounds the conduit 387.

In the illustrated embodiment, the cyclonic separator 322 may be referred to as an integrated component of the wet-dry vacuum cleaner 310 that increases an effectiveness (e.g., suction force, operating strength, etc.) of dirt separation accomplished by the power head 314 by decreasing an amount of debris that travels to the pre-motor filter 334, thus allowing for more air to flow through the pre-motor filter 334 and to the suction motor 326. In operation, the wet-dry vacuum cleaner 310 can be turned on (e.g., energized) to operate the suction motor 326 and draw a dirty air 388 into the cyclonic separator 322 through the dirty air inlet port 370. The dirty air 388 coming into the power head 314 will enter tangentially into a cyclonic chamber 399 of the cyclonic separator 322 and cause the dirty air 388 to spin cyclonically within the cyclonic chamber 399. The cyclonic separator 322 further causes the relatively heavier debris (e.g., dirty liquid droplets, dirt, stones, wood scrap, metal pieces, sand, etc.) to be forced radially outwardly relative the clean air outlet port 374, thereby separating the heavier debris from the dirty air 388 and resulting in clean air 389 moving through the clean air outlet port 374.

With continued reference to FIG. 10, the separated heavier debris will fall into a collection chamber 400 (FIG. 9) of the bin 318 through a plate 410 positioned at least partially within the cyclonic chamber 399 and supported by the cyclonic separator 322. In the illustrated embodiment, the plate 410 includes a conical portion (e.g., may have a conical shape). The plate 410 includes a cutout 414 positioned between a defining wall 418 of the cyclonic chamber 399 and a portion of the plate 410. The defining wall 418 may be an outer or even outermost wall of the cyclonic separator 322 and/or the housing 323 (e.g., the outer wall 324 of the power head 314.

In the illustrated embodiment, the cutout 414 includes an opening 422 that accommodates separation of the heavier debris and allows the heavier debris to fall from the dirty air 388 and into the collection chamber 400. After the heavier debris is separated from the dirty air 388, the resulting clean air 389 will then move radially inwardly toward the clean air outlet port 374. In some embodiments, the resulting clean air 389 passes radially inwardly through a centrally-located cylindrical screen 390 before entering the clean air outlet port 374.

The clean air 389 will then travel down through the clean air outlet port 374 of the cyclonic separator 322 and into the pre-motor filter housing 335. The conduit 387 is generally sealed off from the dirty air 388 and the resulting clean air 389 so that no air enters into the suction motor housing inlet port 386 without passing into the pre-motor filter housing 335. Once in the pre-motor filter housing 335, the clean air 389 will circle around the pre-motor filter housing 335 and pass radially through the exterior surface of the pre-motor filter 334 having a cylindrical shape or body. From there, the clean air 389 will be substantially void of lighter debris and the "filtered" working air will be drawn up through the conduit 387 to the suction motor housing inlet port 386. The working air will then pass through the fan 330 and be exhausted from the power head 314 through the outlet port 336.

The working airflow travels through the cyclonic separator 322, down through the clean air outlet port 374 in the cyclonic separator 322, and through the pre-motor filter 334 before being drawn upwardly across the fan 330 and exhausting through the outlet port 336 on the power head 314.

As illustrated in FIG. 10, the pre-motor filter 334 is cylindrical and hangs down from the power head 314 within the pre-motor filter housing 335. The pre-motor filter housing 335 may include a removable cap 412 threadably connected to the pre-motor filter housing 335. The removable cap 412 may include a bump or pin 416 that supports a bottom end of the pre-motor filter 334. In some embodiments, the pre-motor filter 334 has a recess, such as an aperture or guiding hole, that receives the pin 416. The pre-motor filter 334 may be supported by other portions of the pre-motor filter housing 335 and/or the removable cap 412. As further illustrated in FIG. 10, the pre-motor filter housing 335 blends into the clean air outlet port 374 in the cyclonic separator 322. An upper portion of the pre-motor filter 334, adjacent the instant air coming from the clean air outlet port 374, may be solid (e.g., non-perforated, air-blocking, etc.) so as to force air toward a filter media 420 supported by the pre-motor filter 334. In the illustrated embodiments, the filter media 420 forms a substantially cylindrical body of the pre-motor filter 334, and air passed through vertical side walls of the filter media 420. The pre-motor filter 334 and filter media 420 are further located below the plate 410 and in the collection chamber 400 of the bin 318. The pre-motor filter housing 335 further fully encloses the pre-motor filter 334 and filter media 420 to prevent any debris or dirty air circulating within the bin 318 from contaminating the filter media 420.

Figure 11:
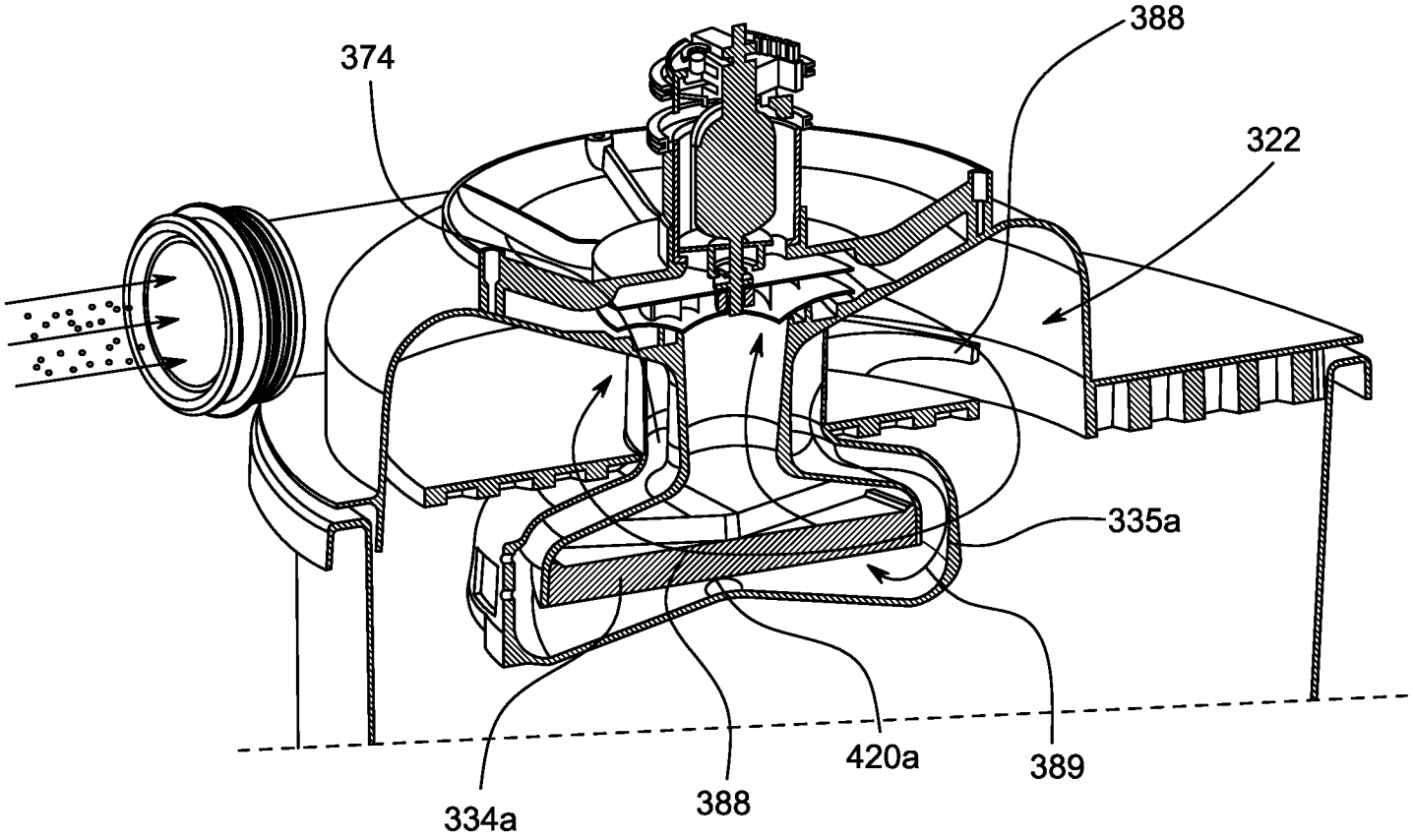
FIG. 11 is a perspective cross-sectional view the wet-dry vacuum and cyclonic separator of FIG. 9, illustrating an alternate filter assembly useable with the wet-dry vacuum and cyclonic separator.

FIG. 11 illustrates an alternate pre-motor filter 334*a* housed within a pre-motor filter housing 335*a*. The pre-motor filter housing 335*a* blends (e.g., receives air) into the clean air outlet port 374 in the cyclonic separator 322, and an upper portion of the alternate pre-motor filter 334*a*, adjacent the instant air coming from the clean air outlet port 374, may be solid (e.g., non-perforated, air-blocking, etc.) so as to force air toward a filter media 420*a* supported by the alternate pre-motor filter 334*a*. In the illustrated embodiment of FIG. 11, the filter media 420*a* forms a substantially flat puck-shaped body of the alternate pre-motor filter 334*a* and is positioned on a lower side of the alternate pre-motor filter 334*a*. Rather than air entering into the alternate pre-motor filter 334*a* through vertical side walls of the filter media 420*a*, air enters into the alternate pre-motor filter 334*a* through a substantially horizontal base wall of the filter media 420*a* and exits through a corresponding horizontal top wall. The filter media 420*a* may be retained in the alternate pre-motor filter 334*a* by one or more support vanes.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described. For example, the various aspects of either wet-dry vacuum cleaner 10, 110, such as the latches 54, 62 could be interchangeably incorporated across multiple embodiments, discussed or otherwise.

What is claimed is:

1. A wet-dry vacuum cleaner comprising:
- a collecting bin; and
- a power head removably coupled to the collecting bin, the power head including
  - a housing configured to support the power head on the collecting bin,
  - an exhaust outlet,
  - a cyclonic separator positioned within the housing, the cyclonic separator including a dirty air inlet, a chamber, and a clean air outlet,
  - a suction motor assembly operable to create a working airflow path from the dirty air inlet to the exhaust outlet, and
  - a filter disposed within a filter housing hanging downwardly from the suction motor assembly, the filter positioned within the working airflow path adjacent the clean air outlet of the cyclonic separator,
  - wherein the filter housing receives air from the clean air outlet of the cyclonic separator,
  - wherein working air in the working airflow path passes over the cyclonic separator before entering the filter housing, and
  - wherein working air is drawn from the clean air outlet of the cyclonic separator downwardly into the filter housing.

2. The wet-dry vacuum cleaner of claim 1, wherein the cyclonic separator is fluidly disposed between the power head and the collecting bin, and wherein the cyclonic separator is configured to separate heavier debris from working air in the working airflow path.

3. The wet-dry vacuum cleaner of claim 1, wherein the filter includes a conduit upstream from the clean air outlet of the cyclonic separator, the conduit accommodating the working airflow path from the filter housing to the exhaust outlet.

4. The wet-dry vacuum cleaner of claim 3, wherein the conduit is at least partially surrounded by the clean air outlet of the cyclonic separator.

5. The wet-dry vacuum cleaner of claim 3, wherein the conduit passes through the clean air outlet of the cyclonic separator, and wherein the conduit separates working air entering the filter housing through the clean air outlet of the cyclonic separator from working air exiting the filter housing toward the exhaust outlet.

6. The wet-dry vacuum cleaner of claim 1, wherein the filter is disposed fluidly downstream of the cyclonic separator and physically below the cyclonic separator, wherein working air in the working airflow path is drawn into the filter and travels away from the cyclonic separator, and wherein working air is drawn into the suction motor assembly and bypasses the cyclonic separator via a conduit after exiting the filter.

7. The wet-dry vacuum cleaner of claim 6, wherein the filter includes a cylindrical body at least partially formed by filter media, and wherein working air is drawn horizontally through the filter media and then vertically toward the exhaust outlet.

8. The wet-dry vacuum cleaner of claim 6, wherein the filter includes a flat body at least partially formed by filter media, and wherein working air is drawn vertically through the filter media and then vertically toward the exhaust outlet.

9. A wet-dry vacuum cleaner comprising:
- a collecting bin;
- a power head removably coupled to the collecting bin, the power head including:
  - a housing configured to support the power head on the collecting bin,
  - a dirty air inlet,
  - an exhaust outlet, and
  - a suction motor assembly operable to draw working air from the dirty air inlet and expel air through exhaust outlet;
- a cyclonic separator integrated within the housing, the cyclonic separator including
  - a plate configured to separate heavier debris from the working air, the plate having an opening defined between the plate and the housing of the power head, the opening allowing heavier debris to fall into the collecting bin, and
  - a clean air outlet positioned within the housing of the power head, the clean air outlet configured to receive working air unladen of heavier debris;
- a filter housing hanging downwardly from the power head, the filter housing receiving air from the clean air outlet of the cyclonic separator;
- a filter supported within the filter housing, the filter being disposed fluidly downstream of the cyclonic separator; and
- a conduit extending from the filter toward the exhaust outlet, the conduit positioned physically in the cyclonic separator but fluidly disposed downstream of the cyclonic separator, the conduit physically separating working air entering into the filter housing though the clean air outlet and working air exiting the filter housing through the conduit, wherein working air passes over the cyclonic separator before entering the filter housing, and wherein working air is drawn from the clean air outlet of the cyclonic separator downwardly into the filter housing.

10. The wet-dry vacuum cleaner of claim 9, wherein working air is drawn into the filter and travels away from the cyclonic separator, and wherein working air is drawn into the suction motor assembly and bypasses the cyclonic separator via the conduit after exiting the filter.

11. The wet-dry vacuum cleaner of claim 10, wherein the filter includes a cylindrical body at least partially formed by filter media, and wherein working air is drawn horizontally through the filter media and then vertically toward the exhaust outlet.

12. The wet-dry vacuum cleaner of claim 10, wherein the filter includes a flat body at least partially formed by filter media, and wherein working air is drawn vertically through the filter media and then vertically toward the exhaust outlet.

13. A wet-dry vacuum cleaner comprising:

a collecting bin; and a power head removably coupled to the collecting bin, the power head including a housing configured to support the power head on the collecting bin, an exhaust outlet, a cyclonic separator positioned within the housing, the cyclonic separator including a dirty air inlet, a chamber, and a clean air outlet, a suction motor assembly operable to create a working airflow path from the dirty air inlet to the exhaust outlet, and a filter disposed within a filter housing hanging downwardly from the suction motor assembly, the filter positioned within the working airflow path adjacent the clean air outlet of the cyclonic separator, wherein the filter is disposed fluidly downstream of the cyclonic separator and physically below the cyclonic separator, wherein working air in the working airflow path is drawn into the filter and travels away from the cyclonic separator, and wherein working air is drawn into the suction motor assembly and bypasses the cyclonic separator via a conduit after exiting the filter.

14. The wet-dry vacuum cleaner of claim 13, wherein the filter includes a cylindrical body at least partially formed by filter media, and wherein working air is drawn horizontally through the filter media and then vertically toward the exhaust outlet.

15. The wet-dry vacuum cleaner of claim 13, wherein the filter includes a flat body at least partially formed by filter media, and wherein working air is drawn vertically through the filter media and then vertically toward the exhaust outlet.

* * * * *